US007736244B2

(12) United States Patent
Hueber

(10) Patent No.: US 7,736,244 B2
(45) Date of Patent: Jun. 15, 2010

(54) GOLF CLUB WITH FLEXIBLE GRIP PORTION

(76) Inventor: David Hueber, 123 Nandina Cir., Ponte Vedra Beach, FL (US) 32082

( * ) Notice: Subject to any disclaimer, the term of this patent is extended or adjusted under 35 U.S.C. 154(b) by 0 days.

(21) Appl. No.: 12/004,239

(22) Filed: Dec. 20, 2007

(65) Prior Publication Data

US 2008/0153620 A1 Jun. 26, 2008

Related U.S. Application Data

(60) Provisional application No. 60/876,817, filed on Dec. 22, 2006.

(51) Int. Cl.
*A63B 53/10* (2006.01)

(52) U.S. Cl. ..... 473/298; 473/319

(58) Field of Classification Search ..... 473/316–323, 473/294, 296, 297, 298–299
See application file for complete search history.

(56) References Cited

U.S. PATENT DOCUMENTS

| | | | | |
|---|---|---|---|---|
| 1,968,616 | A * | 7/1934 | Oldham | 473/298 |
| D93,756 | S | 11/1934 | Barnhart | |
| 2,250,429 | A | 7/1941 | Vickery | |
| 3,809,403 | A * | 5/1974 | Hunter | 473/316 |
| 5,322,290 | A * | 6/1994 | Minami | 473/201 |
| 5,439,219 | A | 8/1995 | Vincent | |
| 5,733,204 | A | 3/1998 | Carrara | |
| 5,735,752 | A | 4/1998 | Antonious | |
| 5,842,930 | A | 12/1998 | Koterba | |
| 5,947,835 | A * | 9/1999 | Fenton, Jr. | 473/229 |
| 6,024,651 | A | 2/2000 | Cheng | |
| 6,042,485 | A | 3/2000 | Cheng | |
| 6,280,347 | B1 | 8/2001 | Herber | |
| 6,582,320 | B2 * | 6/2003 | Fendel | 473/312 |
| 6,625,848 | B1 * | 9/2003 | Schneider | 16/436 |
| 2001/0012803 | A1 | 8/2001 | Feeney | |
| 2002/0098907 | A1 | 7/2002 | Hsu | |
| 2004/0106463 | A1 * | 6/2004 | Horwood et al. | 473/289 |

* cited by examiner

*Primary Examiner*—Stephen L. Blau
(74) *Attorney, Agent, or Firm*—Thomas C. Saitta

(57) ABSTRACT

A golf club shaft wherein the flexibility of the club over a short segment at the butt or grip end is increased in a controlled manner. A flexible tubular shaft insert of approximately 7 to 10 inches in total length having a tapered portion of approximately 2 to 3 inches in length and of increased diameter, the outer diameter of the tapered portion being sized and configured so as to mate with the inner diameter of the actual golf club shaft, is inserted into the shaft. A flexible sleeve is disposed about the exposed extension portion of the tubular shaft insert, the outer diameter of the flexible sleeve approximating the outer diameter of the golf club shaft, such that a standard grip may be applied over the butt end of the shaft and the extended portion of the shaft insert.

18 Claims, 2 Drawing Sheets

GOLF CLUB WITH FLEXIBLE GRIP PORTION

This application claims the benefit of U.S. Provisional Patent Application Ser. No. 60/876,817, filed Dec. 22, 2006.

BACKGROUND OF THE INVENTION

This invention relates generally to the field of golf clubs, and more particularly to the field of golf club shafts having variations in flexibility along certain portions of the shaft, and even more particularly relates to golf club shafts wherein the variation in flexibility occurs in the grip portion.

Steel and graphite composite golf club shafts both have a graduated bend when flexed. Shafts can be designed to be stiffer or more flexible depending on the particular club, the ability of the golfer, etc. The amount of bend in a standard golf shaft is gradually progressive, in that the flex is greater near the tip end, i.e., the club head end, than near the butt or grip end. The flex of the golf shaft enables the golfer to generate increased club head speed, as the shaft bends and then recoils when striking the golf shot. Professional golfers use a stiffer, less flexible shaft because they can then attain the optimum distance with more control. Most golfers, however, need a more flexible shaft in order to maximize club head speed as the ball is struck—the key factor in driving distance. There is a trade-off, however, between power and control, because the more flexible shafts, while increasing distance, have more twist or torque. Torque resistance is desirable in a golf shaft because most golfers do not hit the ball in the center of the clubface. When the ball is hit off-center toward the heel or toe of the club head, the shaft twists and the ball is propelled to the left or right in an exaggerated and undesirable manner. Consequently, there is a need to balance increased distance with loss of control.

The USGA in its "Rules of Golf" requires that at any point along the length of the shaft, the shaft shall bend in such a way that the deflection is the same regardless of how the shaft is rotated about the longitudinal axis and shall twist the same amount in both directions. In other words, there cannot be any preferential deflection in the shaft in a chosen direction, such as in the direction parallel to the perfect shot direction.

Standard golf shafts are tubular members of diminishing diameter progressing from the butt or grip end (the proximal end held by the golfer) to the tip end (the end connected to the club head). The flex of the shaft is determined primarily by the diameter of the shaft. If the diameter is wider throughout the shaft, it will be stiffer than a shaft constructed of similar material that is thinner in diameter through the shaft. The flex and torque of the shaft can be controlled more in graphite shafts as opposed to metal shafts thorough selectivity and application of resins and carbon fiber materials. However, in the traditional design, it is difficult for either steel or graphite shaft makers to significantly alter the flex point of the shaft or create other desirable performance characteristics in a shaft.

Attempts to optimize golf club shaft design and structure can be seen in U.S. Pat. No. 5,842,930 to Koterba, U.S. Pat. No. 5,733,204 to Carrara, U.S. Pat. No. 2,250,429 to Vickery, U.S. Pat. No. 5,735,752 to Antonious, U.S. Pat. No. 6,024,651 to Cheng, U.S. Pat. No. 6,042,485 to Cheng, U.S. Pat. No. 6,280,347 to Herber, U.S. Pat. No. 5,439,219 to Vincent, U.S. Patent Application Publication No. 2001/0012803 to Feeney, and U.S. Patent Application Publication No. 2002/0098907 to Hsu. These devices have failed to provide an optimum solution to the problem of balancing control and distance.

It is an object of this invention to provide a golf club wherein the flex is optimized relative to standard golf club shaft construction. It is a further object to provide a golf shaft and club of improved flex and control wherein the improved flexibility occurs at or near the proximal end of the golf club, i.e., within the upper butt section or grip portion of the club.

SUMMARY OF THE INVENTION

The invention is a golf club wherein the flexibility of the golf club shaft at the butt or grip end is increased in a controlled manner by providing a more flexible section along the butt end of the golf club shaft. The flexible portion extends approximately 5 to 7 inches in length. A flexible tubular shaft insert member of approximately 7 to 10 inches in length comprising an insert extension portion approximately 5 to 7 inches in length and an insert tapered portion approximately 2 to 3 inches in length and of greater diameter than the extension portion, is mated with the golf shaft. The tapered portion has an outer diameter sized and configured so as to correspond and mate with the inner diameter and internal tapering of the golf club shaft. The tapered portion is inserted into the proximal end of the shaft such that the extension portion extends coaxially from the end of the golf shaft. A flexible sleeve is disposed about the insert extension portion, the outer diameter of the flexible sleeve approximating the outer diameter of the golf club shaft, such that a standard grip may be applied over the butt end of the shaft and the extension portion of the shaft insert. Preferably, the flexible tubular shaft insert is composed of a graphite composite material.

DETAILED DESCRIPTION OF THE INVENTION

Figure 1:
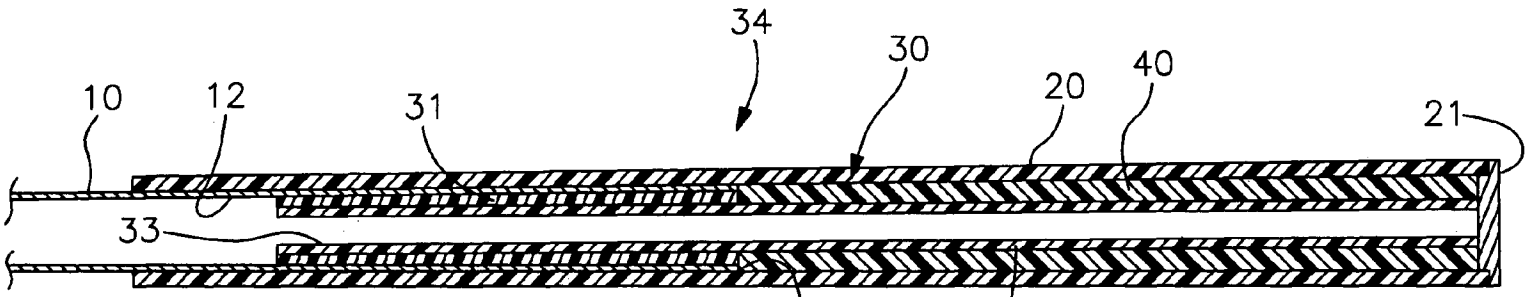
FIG. 1 is a partial cross-sectional view of the improved golf club.
Figure 2:
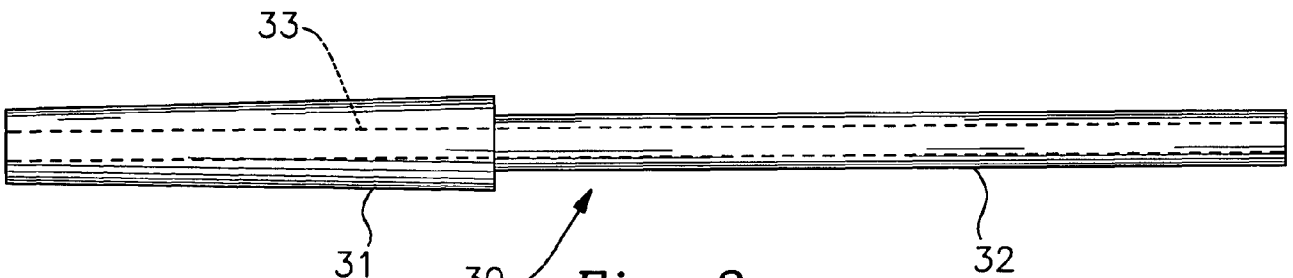
FIG. 2 is a view of the flexible insert member.
Figure 3:
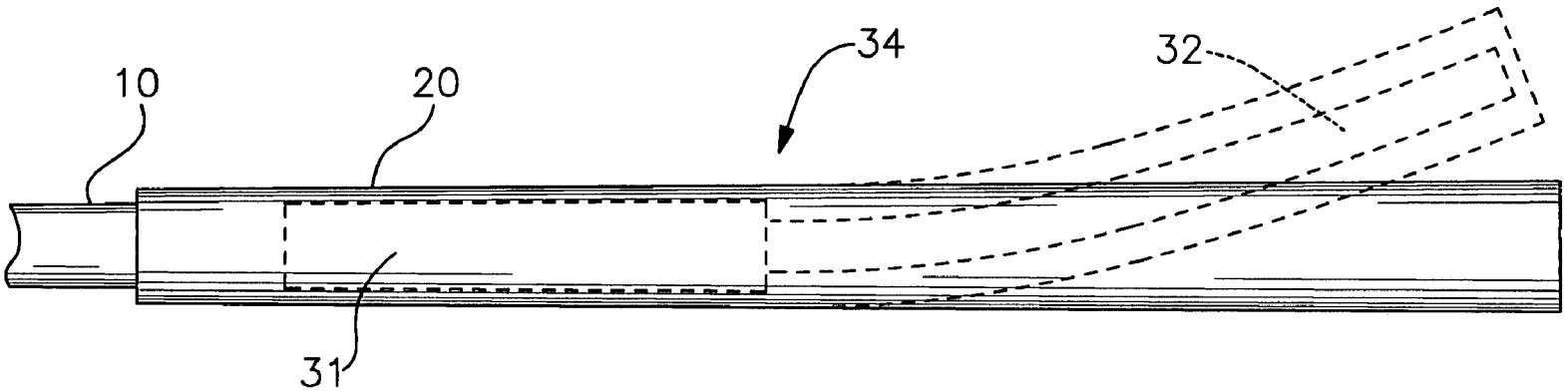
FIG. 3 is a partial view of the golf club showing the extension portion of the flexible insert member in the flexed state.

With reference to the drawing, the invention will now be described in detail with regard for the best mode and preferred embodiment. In general, the invention is an improved construction for a golf club wherein the flexibility of the club at or near the butt end, i.e., at the grip portion, is increased in a controlled manner.

The invention comprises a flexible tubular insert 30, preferably composed of a graphite composite material formed in a layered manner, the flexible insert 30 comprising a tapered portion 31 and a tubular extension portion 32, preferably cylindrical, with an insert bore 33 extending the length of the flexible insert 30. The degree of flexibility in the flexible insert 30 and therefore the degree of flexibility of the butt end portion of the golf club may be varied by altering the material, pattern of layering, reinforcement material, bore size 33, etc., of the flexible insert 30. Other materials, such as carbon rods, fiberglass or materials with similar characteristics, may also be use to form the flexible insert 30. The flexible insert 30 may be formed as a single member, or the tapered portion 31 may be formed by positioning a tapered sleeve over one end of a tubular rod, as shown in FIG. 1. The degree of taper in the tapered portion 31 is chosen to correspond with the tapering found in the bore 12 of the golf club shaft 10 at its shaft butt end 11.

With the tapered portion 31 inserted into the shaft bore 12 and bonded using suitable adhesives, the tubular insert extension portion 32 extends coaxially beyond the butt end 11 of the golf club shaft 10. The inner and outer diameters of the insert extension portion 32 preferably approximate the inner and outer diameters of the golf club shaft 10 at its tip, such that the insert extension portion 32 is much more flexible than the proximal portion of the golf shaft 10, due to the much greater outer diameter of the golf shaft 10. A flexible cover sleeve 40 is coaxially placed around the insert extension portion 32, the thickness of the cover sleeve 40 being chosen such that its outer diameter generally matches the outer diameter of the golf club shaft 10 at its butt end 11. In this manner, a standard grip member 20 and grip cap member 21 may be disposed on the golf club shaft 10 and flexible insert 30 in known manner without resulting in any undesirable transition shoulders or edges. The flexibility of the cover sleeve 40 may also be varied in order to affect the flexibility of the flexible insert 30. Thus, the flexible cover sleeve 40 may be stiffer in order to reduce the flexibility of the flexible insert member 30, or the cover sleeve 40 may be composed of material similar or even greater in flex characteristics to the material composing the flexible insert 30 such that minimal limiting effect is created.

With this construction, the golf club has a flex range or bend profile beginning at the location 34 where the insert extension portion 32 meets the shaft butt end 11 and extending to the end of the club, with the construction of the flexible insert member 30 allowing the flex to diffuse along the extension portion 32 such that excessive shear forces are not present at the initial flex point 34. This construction allows for flex over the full length of the insert extension portion 32 and between the hands of the golfer. This creates a whip-like response in the club as it is swung. The degree of flex can be controlled and optimized relative to the strength and skill levels of individual golfers. The shaft flex at the top of the golf swing can be increased by 30 degrees over a standard golf shaft. The lightweight composition of the flexible shaft insert 30 does not adversely affect the balance of the club. In fact, the weight of the insert requires that some additional weight be added to the club head in order to maintain the traditional swing weight in the range of D1 to D5. This counterbalancing allows for a club head weight that can be about 15 to 20 grams heavier. The result of this additional club head mass is greater distance, assuming that the club head velocity increases as well. The physics is $E=MV^2$, where the increased mass times velocity squared translates into greater distance for a golfer using this club.

While absolute dimensions will vary due to many factors, a representative flexible insert 30 may be between about 7 and 10 inches in length, preferably about 7 to 8 inches. The tapered portion 31 will preferably have a length of about 2 to 3 inches, and the insert extension portion 32 will preferably have a length of about 5 to 7 inches. In a typical golf club shaft 10 having a wall thickness of about 1/32 inches and an inner bore 12 of about 11/32 inches at its butt end 11, the tapered portion 31 will have outer dimensions diminishing from about 16/32 to about 11/32 inches to match the taper of the shaft 10. The insert bore 33 is about 6/32 inches with a thickness of about 3/32 inches on the extension portion 32, the extension portion 32 having an outer diameter of about 12/32 inches.

It is contemplated that equivalents and substitutions for certain elements and structure set forth above may be obvious to those skilled in the art, and therefore the true scope and definition of the invention is to be as set forth in the following claims.

I claim:

1. A golf club comprising:

a club shaft having a shaft bore and a butt end;

a flexible tubular insert member mated with said club shaft, said flexible tubular insert member comprising a tapered portion and an extension portion, wherein said tapered portion is inserted into said shaft bore such that said extension portion extends coaxially from said butt end of said club shaft, and wherein the outer diameter of said tapered portion is greater than the outer diameter of said extension portion;

a flexible cover sleeve coaxially mounted onto said extension portion; and a grip member coaxially mounted onto said flexible cover sleeve and a portion of said club shaft;

wherein said flexible cover sleeve is stiffer than said extension portion.

2. The club of claim 1, wherein the outer diameter of said extension portion is less than the outer diameter of said butt end of said club shaft.

3. The club of claim 1, wherein said flexible tubular insert member further comprises a bore extending through said tapered portion and said extension portion.

4. The club of claim 1, wherein the outer diameter of said flexible cover sleeve approximates the outer diameter of said butt end of said club shaft.

5. The club of claim 1, wherein said extension portion is cylindrical.

6. The club of claim 1, wherein said flexible tubular insert member is composed of a graphite composite material.

7. The club of claim 1, wherein said flexible tubular insert member is approximately from 7 to 10 inches in length, and wherein said tapered portion is approximately about 2 to 3 inches in length and said extension portion is approximately 5 to 7 inches in length.

8. The club of claim 1, wherein the outer diameter of said extension portion is approximately equal to the smallest outer diameter of said club shaft.

9. A golf club comprising:

a club shaft having a shaft bore and a butt end;

a flexible tubular insert member mated with said club shaft, said flexible tubular insert member comprising a tapered portion and an extension portion, wherein said tapered portion is inserted into said shaft bore such that said extension portion extends coaxially from said butt end of said club shaft, wherein the outer diameter of said tapered portion is greater than the outer diameter of said extension portion, and wherein the outer diameter of said extension portion is less than the outer diameter of said butt end of said club shaft;

a flexible cover sleeve coaxially mounted onto said extension portion, wherein the outer diameter of said flexible cover sleeve approximates the outer diameter of said butt end of said club shaft; and a grip member coaxially mounted onto said flexible cover sleeve and a portion of said club shaft.

10. The club of claim 9, wherein said flexible tubular insert member further comprises a bore extending through said tapered portion and said extension portion.

11. The club of claim 9, wherein said flexible cover sleeve is stiffer than said extension portion.

12. The club of claim 9, wherein said extension portion is stiffer than said flexible cover sleeve.

13. The club of claim 9, wherein said extension portion is cylindrical.

14. The club of claim 9, wherein said flexible tubular insert member is composed of a graphite composite material.

15. The club of claim 9, wherein said flexible tubular insert member is approximately from 7 to 10 inches in length, and wherein said tapered portion is approximately about 2 to 3 inches in length and said extension portion is approximately 5 to 7 inches in length.

16. The club of claim 9, wherein the outer diameter of said extension portion is approximately equal to the smallest outer diameter of said club shaft.

17. A golf club comprising:

a club shaft having a shaft bore and a butt end;

a flexible tubular insert member mated with said club shaft, said flexible tubular insert member comprising a tapered portion, a cylindrical extension portion, and a coaxial bore extending through said tapered portion and said extension portion, wherein said tapered portion is inserted into said shaft bore such that said extension portion extends coaxially from said butt end of said club shaft, wherein the outer diameter of said tapered portion is greater than the outer diameter of said extension portion, and wherein the outer diameter of said extension portion is approximately equal to the smallest outer diameter of said club shaft;

a flexible cover sleeve coaxially mounted onto said extension portion, wherein the outer diameter of said flexible cover sleeve approximates the outer diameter of said butt end of said club shaft; and a grip member coaxially mounted onto said flexible cover sleeve and a portion of said club shaft.

18. The club of claim 17, wherein said flexible tubular insert member is composed of a graphite composite material, wherein said flexible tubular insert member is approximately from 7 to 10 inches in length, and wherein said tapered portion is approximately about 2 to 3 inches in length and said extension portion is approximately 5 to 7 inches in length.

* * * * *